United States Patent [19]

Santalla et al.

[11] Patent Number: 4,672,900

[45] Date of Patent: Jun. 16, 1987

[54] SYSTEM FOR INJECTING OVERFIRE AIR INTO A TANGENTIALLY-FIRED FURNACE

[75] Inventors: Richard W. Santalla; Angelos Kokkinos, both of Enfield; Robert J. Collette, Windsor; Michael S. McCartney, Bloomfield, all of Conn.

[73] Assignee: Combustion Engineering, Inc., Windsor, Conn.

[21] Appl. No.: 474,114

[22] Filed: Mar. 10, 1983

[51] Int. Cl.[4] ..... F23D 1/00; F23K 1/00

[52] U.S. Cl. ..... 110/264; 110/265; 110/213; 431/9

[58] Field of Search ..... 431/9; 110/213, 264, 110/265, 319

[56] References Cited

U.S. PATENT DOCUMENTS

| | | | |
|---|---|---|---|
| 2,483,728 | 10/1949 | Glaeser | 110/244 X |
| 3,224,419 | 12/1965 | Lowenstein et al. | 110/264 X |
| 3,688,747 | 9/1972 | Connell | 110/264 X |
| 3,914,090 | 10/1975 | Pfefferle | 431/9 |
| 4,150,631 | 4/1979 | Frey et al. | 110/265 X |
| 4,177,740 | 2/1979 | Lamb et al. | 110/213 |
| 4,246,853 | 1/1981 | Mehta | 110/263 |
| 4,252,069 | 2/1981 | McCartney | 110/265 |
| 4,367,686 | 1/1983 | Adrian | 110/264 |
| 4,438,709 | 3/1984 | Borio et al. | 110/263 |

*Primary Examiner*—Henry G. Yuen

*Attorney, Agent, or Firm*—Arthur E. Fournier, Jr.

[57] ABSTRACT

A tangentially-fired furnace is disclosed in enough detail to illustrate the location of injection ports for excess air above the fireball of the combustion chamber to eliminate the swirl of the flue gases as the flue gases flow into the convection section, in order to produce a uniform mass flow and temperature pattern of the flue gases over the cross section of the furnace exit.

2 Claims, 3 Drawing Figures

SYSTEM FOR INJECTING OVERFIRE AIR INTO A TANGENTIALLY-FIRED FURNACE

TECHNICAL FIELD

The present invention relates to staging the introduction of excess air to the combustion of a tangentially-fired furnace to control the mass flow and temperature pattern of the flue gases exiting the combustion chamber. More particularly, the invention relates to injecting a portion of the excess air into the latter stage of tangential firing in the direction and quantity to produce uniform mass flow and temperature patterns.

BACKGROUND ART

The combustion of any fossil fuel requires a fixed and known quantity of combustion air required to burn any given quantity of fuel. This match between air and fuel is referred to as stoichiometric combustion conditions. It is only in theory that stoichiometric air can be supplied to the combustion and all the fuel be consumed. As a practical matter, a furnace of infinite size would be required. Therefore, more air is supplied than is theoretically required. This additional quantity is referred to as "excess, secondary" air. If excess, secondary air were not added to a standard size furnace, the substoichiometric combustion would produce flue gas with significant quantities of incomplete products of combustion which would constitute hydrocarbons, char, and carbon monoxide. The excess air eliminates these undesirable elements, but at the same time, provides $O_2$ for the formation of nitrous oxide or Nox is a regulated pollutant. To provide a satisfactory balance between the two extreme conditions, only stoichiometric air is injected for the first parts of the combustion process and the remaining portion of the excess air is subsequently injected through overfire air (OFA) ports. A representative literature on this subject is the Leslie Pruce article "Reducing NOX Emissions At The Burner, In The Furnace, And After Combustion" appearing on pages 33–40 of the January, 1981 issue of Power.

In tangential firing, the products of combustion are forced into a rotating or swirling pattern in the furnace. This is excellent for mixing fuel and air but has several drawbacks. First, it produces a lot of horizontal gas patterns, many of which collide with the boundary waterwall and deposit ash on the walls of the furnace. Secondly, the change in direction of the swirling pattern into the non-swirl convection section causes a non-uniform pattern, and a maldistribution of temperature and mass flow across the furnace outlet plane is known as "unbalance". Unbalance leads to numerous operational and design problems which have always been considered as a "given" with this form of firing system. If the overfire, secondary excess air can be introduced to eliminate the swirl prior to entry of the flue gases into the convection section, the unbalance phenomena will be avoided without affecting the swirl in the early part of the combustion process.

DISCLOSURE OF THE INVENTION

The present invention contemplates introducing a portion of the secondary excess air in a tangentially-fired furnace above the substoichiometric combustion of the fireball in the control of NOx generation, and in the direction, quantity and velocity which will eliminate the swirl of flue gases from the fireball and, therefore, the unbalance of temperature in the mass flow to the convection section.

The invention further contemplates the injection of sufficient excess air in opposition to the swirl of the upper portion of the fireball at the velocity and in the quantities which will produce the desired uniform distribution of mass flow and therefore the temperature pattern in the flue gases passing to the convection section.

Other objects, advantages and features of this invention will become apparent to one skilled in the art upon consideration of the written specification, appended claims, and attached drawings.

BRIEF DESIGNATION OF THE DRAWINGS

TERMS, TECHNOLOGY, AND PRIOR ART

Figure 1:
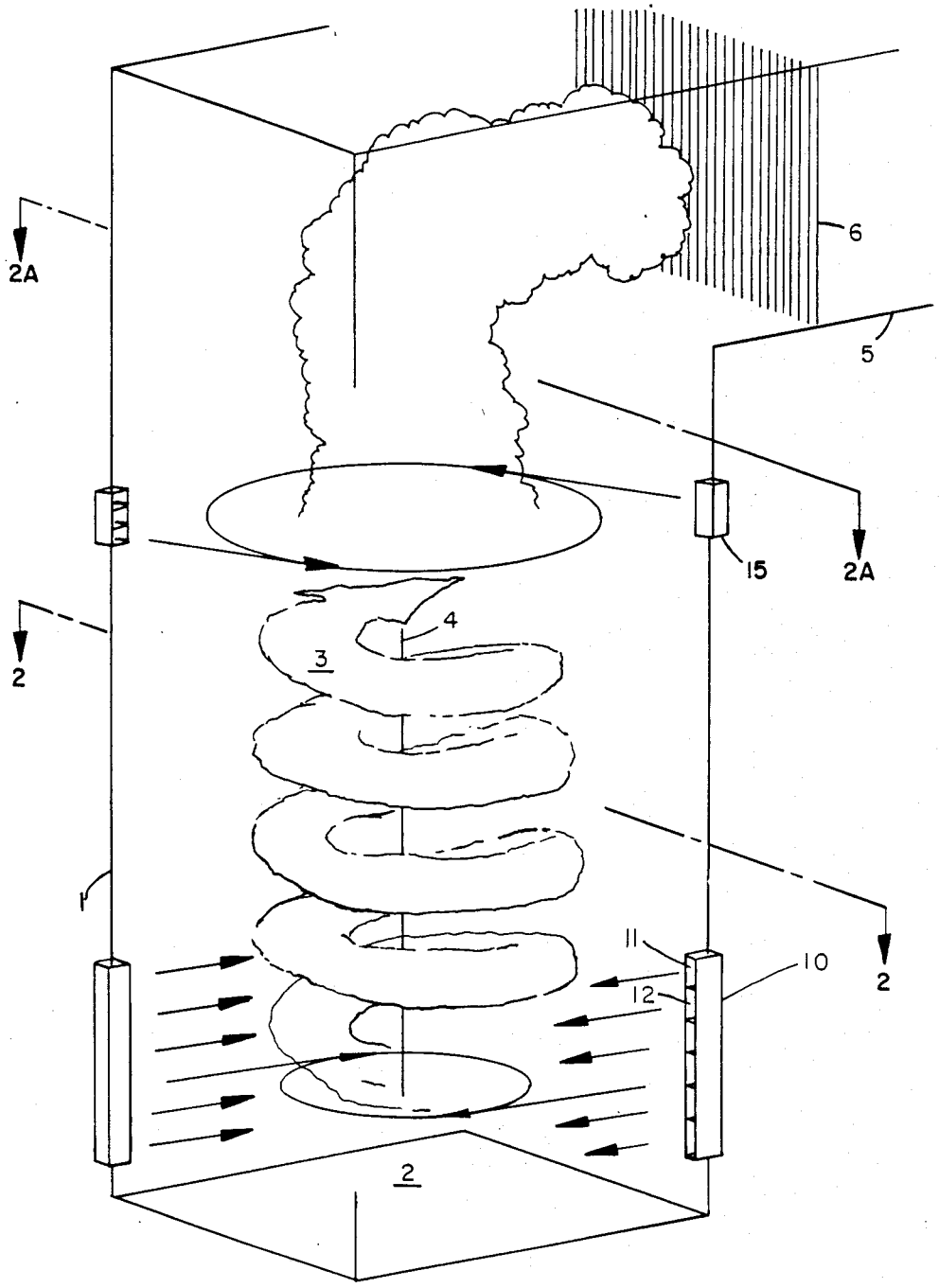
FIG. 1 is a sectioned perspective of a tangentially-fired furnace in which the means injecting the secondary air embodies the present invention.

Glaeser U.S. Pat. No. 2,483,728 discloses the introduction of secondary air to modify the flow pattern of the products of combustion. It is by now well-known to inject a portion of the secondary air downstream of substoichiometric combustion to reduce the formation of NOx. However, the prior art has completely lacked the concept of introducing secondary air downstream of substoichiometric combustion with the direction and in the quantity to simultaneously militate against NOx formation and eliminate the swirl of the products of the substoichiometric combustion. The present invention includes the concept of controlling NOx formation, controlling slag impingement, and providing uniformity of the temperature profile of the products of combustion in one stroke.

The operation of the tangentially-fired, pulverized coal-burning furnace is too well-known to lavish excessive disclosure on its delineation. The fuel, entrained by its primary air, and a portion of the secondary air are directed from the windboxes with the force and direction to generate a swirling fireball. The angular momentum of the fireball is regulated by pivoting the fuel and air nozzles in the windboxes of the furnace corners. The secondary air introduced at the level of the fireball can be readily divided between the fireball, itself, and the annulus between the fireball and the walls of the furnace combustion chamber. It is common practice to maintain a substoichiometric combustion within the fireball by adjustment of the secondary air and introducing the remaining secondary air above the fireball in overall control of combustion to militate against NOx formation. It is the present invention which steps in and not only introduces this NOx-eliminating secondary air above the fireball, but does so in the direction, quantity and velocity to simultaneously eliminate the swirl of the products of combustion flowing downstream of the fireball to equalize the temperatures throughout the mass flow of the products of combustion as they leave the combustion chamber for the economizer section of the furnace.

Let there be no mistaking what is meant by primary air, as contrasted to secondary air in the combustion process. Pulverized fuel, typically coal, is transported by entrainment in the so-called primary air to and through fuel nozzles for injection into the fireball. All additional air required to complete the combustion of the fuel is termed secondary air. This secondary air may be injected at different points and directed in various relationships to the fireball and its products of combustion. No matter how divided or how injected, all this air falls under the term "secondary".

The plurality of fuel nozzles and secondary air nozzles are directed to one side of the vertical centerline of the combustion chamber at varying degrees. The end result is a tornado of burning fuel around the centerline. Thus, we have a ball of fire whirling at a high angular momentum at and about the centerline. The term "fireball" is quite appropriate, whether the fuel and air are whirling, spinning, or revolving.

As an integrated part of a low NOx firing system, the overfire, secondary air would be injected in a manner which provides equal but opposite angular momentum to the angular momentum of the lower fuel and air. By injecting overfire air (OFA) in a counterclockwise motion above a clockwise rotating fireball, the products of combustion above the OFA will have essentially no rotation which is commonly referred to as "plug flow". It is the elimination of a rotating pattern of the products of combustion which reduces the probability of ash particles migrating to the boundary walls (slagging) and simultaneously provide condition ideal for flowing into the convection section.

BEST MODE FOR CARRYING OUT THE INVENTION

In FIG. 1, only those portions of furnace 1 have been disclosed to enable understanding the invention. In furnace 1, combustion chamber 2 has fireball 3 generated about central axis 4. The products of combustion from fireball 3 ascend toward exit passageway 5. Passageway 5 contains economizer 6 through which feedwater is passed to bring it into indirect heat exchange with the products of combustion.

No disclosure will be expended upon the details of the tubes which line the walls of combustion chamber 2, or the connections between these tubes and the feedwater tubes of economizer 6. It is general knowledge that the feedwater absorbs heat from the products of combustion by the use of the economizer and is subsequently vaporized into steam by absorbing heat from the fireball.

It is important to note that windbox 10 represents all the windboxes established in the corners of the combustion chamber 2. Through these windboxes pass the pulverized solid fuel (coal) and the air necessary to sustain combustion in the fireball 3. Both the fuel nozzles and secondary air nozzles of the windboxes are vertically and horizontally tiltable in distribution of the primary air-entrained fuel and the secondary air. Specifically, fuel nozzle 11 and secondary air nozzle 12 in windbox 10 represent the number of fuel and air nozzles which may be required in a particular design.

Figure 2:
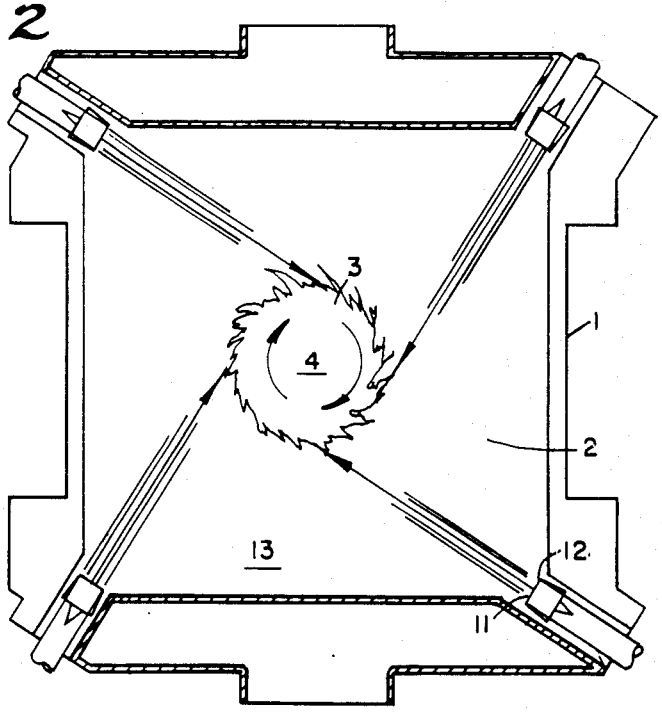
FIG. 2 is a sectioned plan view of the furnace of FIG. 1 taken along lines 2—2.

FIG. 2 is utilized to look down on the combustion chamber 2 in order to disclose how the nozzles 11 and 12 are directed a predetermined number of degrees to one side of central, vertical axis 4. Again, all the nozzles of the windboxes represented by windbox 10 are directed the predetermined number of degrees to the left of the axis to generate fireball 3. As the load on the furnace fluxuates, the fuel and air nozzles may be tilted in coordination with the amounts of fuel and air required to regulate the amount of heat distributed in combustion chamber 2.

Particular note is to be made of the fact that the secondary air nozzle 12 may be tilted to divide its air between that required in the fireball to sustain combustion, and the amount that may be selected for the annulus 13 between the fireball and the walls of the combustion chamber. The amount of the secondary air is established to maintain the desired substoichiometric combustion conditions in the fireball. The remainder of the secondary air required downstream of the fireball is supplied in accordance with the invention.

Figure 2A:
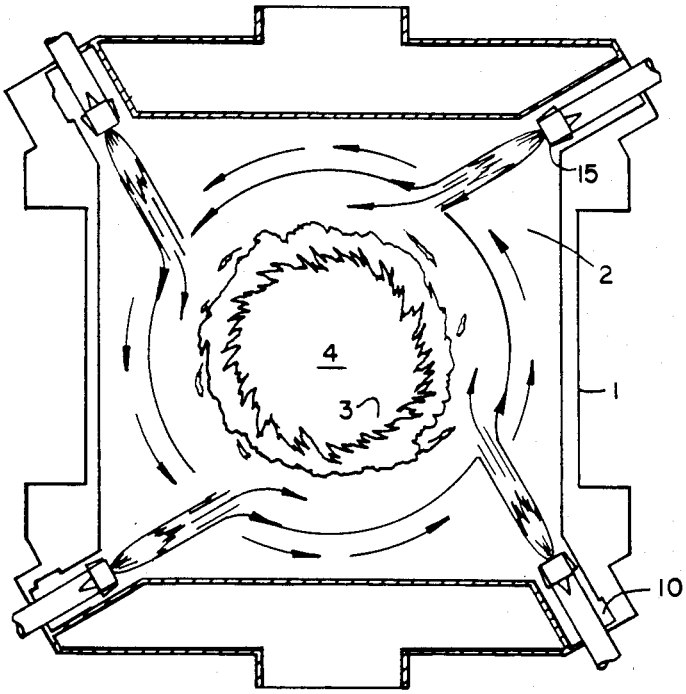
FIG. 2*a* is a sectioned plan view of the furnace of FIG. 1 taken along lines 2*a*—2*a*.

FIG. 2*a* is provided to disclose the relationship between nozzles 15 and nozzles 11 and 12. Nozzles 15 are mounted through the upper wall of the combustion chamber 2 to introduce that amount of secondary air required to complete the combustion of the fireball and militate against the production of NOx. The number of nozzles 15 required is a matter of design, but it is under the teachings of the present invention that these nozzles be mounted to direct the secondary air in opposition to the rising, swirling fireball and the products of combustion emanating from the fireball and flowing upward. Thus, in both direction and amount, this secondary air simultaneously militates against the formation of NOx and neutralizes the swirl of the products of combustion. The result is a gas flow pattern which has no horizontal movement in the upper furnace, or a pattern which moves in a straight line toward the furnace outlet. This "straight line" gas flow pattern eliminates the temperature and mass flow "unbalance" in the upper furnace while simultaneously reducing the probability of ash particles migrating to the boundary walls to form slag.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

We claim:

1. A tangentially-fired, pulverized coal-burning furnace, including, a combustion chamber of substantially square cross section, pivotable fuel and air nozzles in each corner of the combustion chamber ejecting fuel and air to generate flames relative the centerline of the chamber to form a fireball swirling about the axis of chamber, an exit from the upper portion of the combustion chamber for the flue gases generated in the combustion chamber.

a convection section connected to the flue gas exit downstream of the combustion chamber, and at least one nozzle mounted in the upper portion of the combustion chamber ejecting secondary air in the direction and volume and at the velocity to oppose the swirl of the fireball in its upper portion to produce a uniform nonswirling mass flow of exit gases from the combustion chamber to the flue gas outlet and militate against the formation of NOx.

2. A coal-burning, tangentially-fired furnace, including, a combustion chamber, windboxes spaced horizontally in the walls of the combustion chamber, at least one fuel nozzle in each windbox ejecting air-entrained coal horizontally a predetermined distance to one side of the vertical axis of the combustion chamber, at least one nozzle in each windbox ejecting secondary air in the arrangement to divide the secondary air between the combustion of the fuel and the annular space between the combusting fuel and the walls of the combustion chamber, a passage connected to the top of the combustion chamber to receive the products of combustion, an economizer section mounted in the passage with which to indirectly heat exchange feedwater to the furnace and the products of combustion in the passage, and at least one nozzle mounted in the furnace between the combustion chamber and the passage to inject secondary air in opposition to the swirl of the products of combustion from the combustion chamber in the amount and direction and at the velocity to militate against NOx formation and eliminate the swirl of the products of combustion which produces a uniform temperature profile in the products of combustion as they flow down the passage to the economizer section.

* * * * *